US005984101A

United States Patent [19]

Zamora et al.

[11] Patent Number: 5,984,101

[45] Date of Patent: Nov. 16, 1999

[54] SHIPPING PROTECTOR

[75] Inventors: Victoriano Zamora; Jose Oliva, both of Nuevo Leon; Nestor Hernandez, Mirador Residencial Monterrey, all of Mexico

[73] Assignee: Carrier Corporation, Syracuse, N.Y.

[21] Appl. No.: 09/140,490

[22] Filed: Aug. 26, 1998

[51] Int. Cl.[6] ..... B65D 81/02

[52] U.S. Cl. ..... 206/586; 206/592

[58] Field of Search ..... 206/523, 586, 206/591, 592, 593, 594, 521, 320

[56] References Cited

U.S. PATENT DOCUMENTS

| | | | |
|---|---|---|---|
| 4,201,293 | 5/1980 | Rigazio et al. | 206/523 |
| 4,856,656 | 8/1989 | Sugimoto et al. | 206/523 |
| 4,883,179 | 11/1989 | Dionne | 206/523 |
| 5,226,543 | 7/1993 | Foos et al. | 206/592 |

*Primary Examiner*—Jacob K. Ackun

[57] ABSTRACT

A shipping protector is provided which is to be disposed between a substantially rectangular article and a shipping container for the article. The article is of the type having a base having four base corners and a top having four top corners, each of which is in substantially vertically spaced relationship with one of the base corners. The protector includes a base support configured to engage the article's base and each of the base corners. The base support has a thickness sufficient to define an upwardly facing surface adjacent each of the base corners. A first top support is provided which is configured to engage two of the top corners and which has a downwardly extending structural section adjacent each of the corners. The structural sections have a length sufficient to allow the lower ends thereof to engage the upwardly facing surface associated with one of the base corners. A second top support, similar to the first, is configured to engage the other two of the top corners and has similarly configured downwardly extending structural sections. As a result, with the base support and the first and second top supports engaging the article to be shipped while in the shipping container, vertical forces applied to the container will be reacted to the top supports and will be transferred through the downwardly extending sections to the base support.

5 Claims, 3 Drawing Sheets

SHIPPING PROTECTOR

BACKGROUND OF THE INVENTION

The present invention relates to a protector for interposition between an object being shipped and a shipping container, and particularly to such a protector providing adequate support for a substantially rectangular object, which is packaged in a shipping container and is subject to such containers being stacked on top of one another.

It is common practice when packing various objects in a shipping carton to provide protecting means between the object being shipped and an outer packaging such as a cardboard box. Such protecting means commonly take the form of styrofoam protectors positioned upon the corners of the objects being shipped to in effect suspend the object within the shipping container.

Specifically, it is common practice when shipping substantially rectangularly shaped window room air conditioners to provide several styrofoam protecting means to engage the corners thereof prior to placing the air conditioner in its final shipping carton.

It has been found that prior art protecting means for window air conditioners have not provided adequate protection during shipping and storage. Specifically, it has been found that in some large air conditioners, which include heavy compressors, the basepan is not adequately supported and may flex and distort during shipping. Further, it is common practice when shipping air conditioners contained in cardboard cartons to stack a number of units one upon the other in trucks, warehouses and other storage locations. Such stacking of components has been found to result in damage to the air conditioner housing as a result of multiple units being stacked one upon the other. Another mode of damage experienced with such units is experienced when strapping materials and the like are wrapped around an individual carton, or a number of cartons contained upon a pallet or the like are retained by restraining straps which impart forces upon unprotected portions of the container and results in distortion and damage to the article within the container.

Accordingly, it is desirable to have a protecting means for room air conditioners and other similarly shaped rectangular objects which will provide protection to the unit under the above described conditions of shipping and/or storage.

SUMMARY OF THE INVENTION

A shipping protector is provided which is to be disposed between a substantially rectangular article and a shipping container for the article. The article is of the type having a base having four base corners and a top having four top corners, each of which is in substantially vertically spaced relationship with one of the base corners. The protector includes a base support configured to engage the article's base and each of the base corners. The base support has a thickness sufficient to define an upwardly facing surface adjacent each of the base corners. A first top support is provided which is configured to engage two of the top corners and which has a downwardly extending structural section adjacent each of the corners. The structural sections have a length sufficient to allow the lower ends thereof to engage the upwardly facing surface associated with one of the base corners. A second top support, similar to the first, is configured to engage the other two of the top corners and has similarly configured downwardly extending structural sections. As a result, with the base support and the first and second top supports engaging the article to be shipped while in the shipping container, vertical forces applied to the container will be reacted to the top supports and will be transferred through the downwardly extending sections to the base support.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENT

Figure 1:
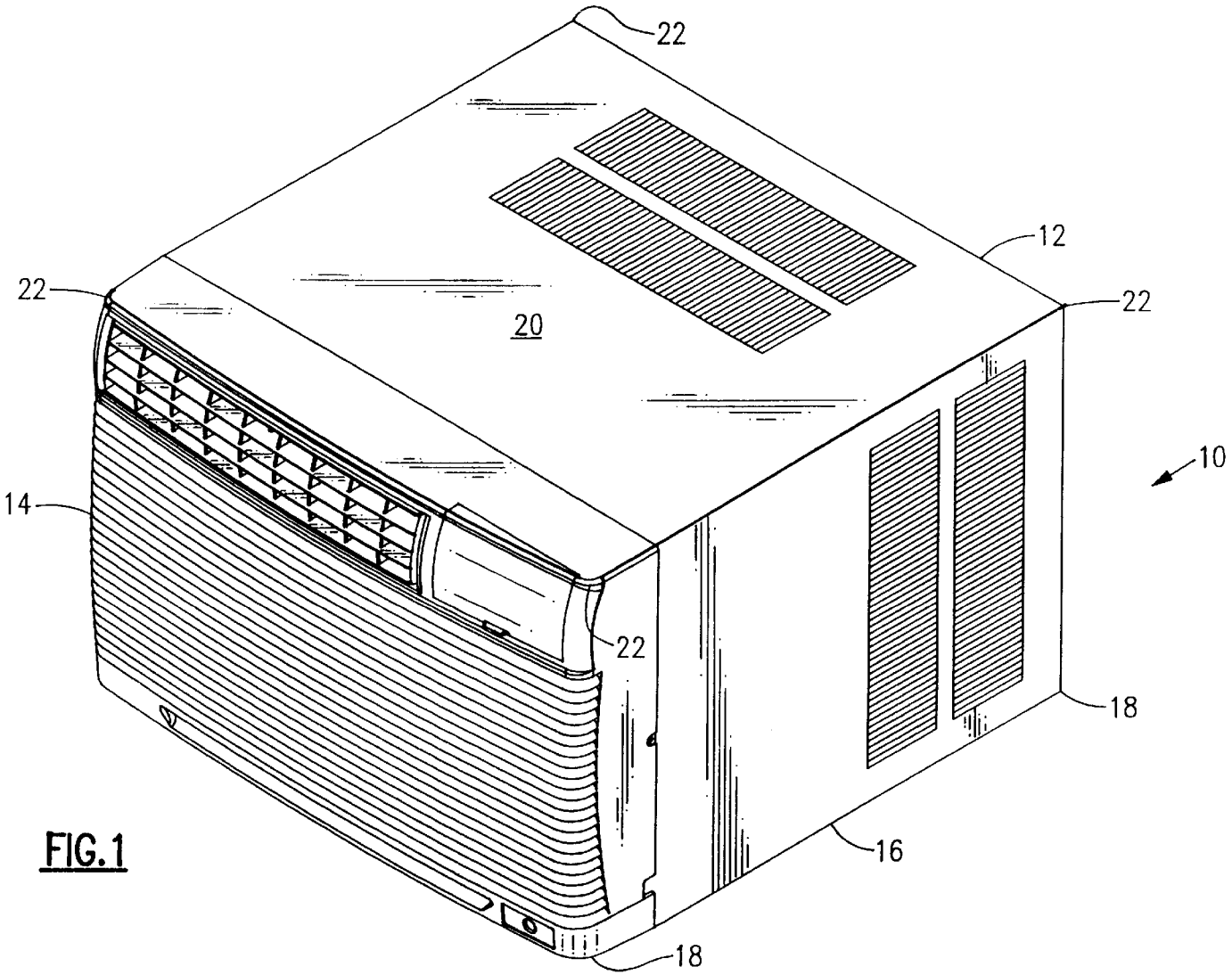
FIG. 1 is a perspective view of a window room air conditioner of the type for use with the shipping protector of the present invention.

FIG. 1 illustrates a window room air conditioner unit 10, which is enclosed within a substantially rectangular housing 12 and which has a front grille 14 attached to the front side thereof. The air conditioning unit is substantially rectangular and has a lower base section 16, defining four lower or base corners 18 and a substantially planar top 20 defining four top corners 22.

Figure 3:
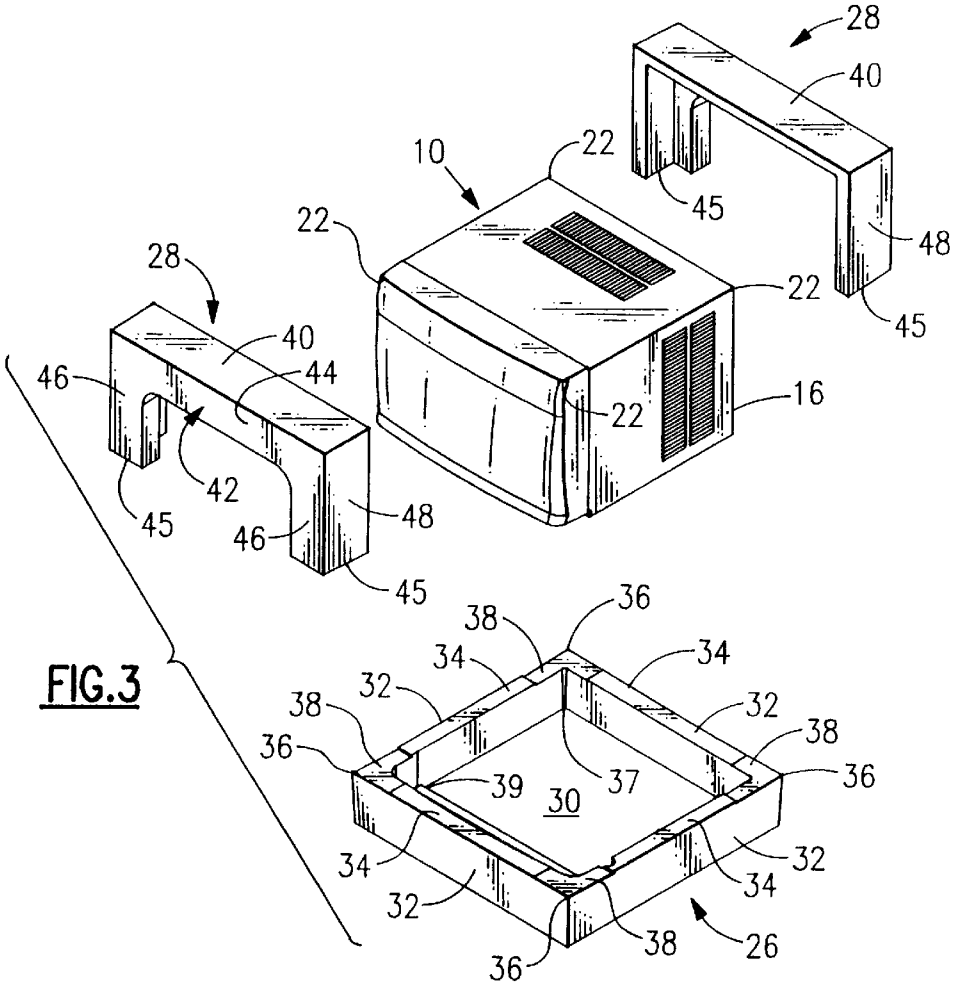
FIG. 3 is an exploded perspective view of the components illustrated in FIG. 2.
Figure 2:
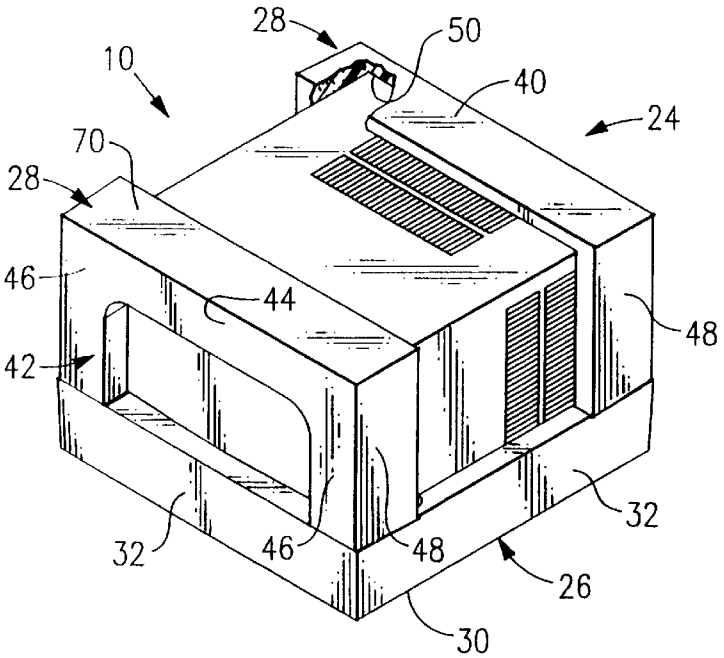
FIG. 2 illustrates the air conditioner of FIG. 1 being supported by a shipping protector according to the present invention.

Looking now at FIGS. 2 and 3, a shipping protector 24 according to the present invention includes a base support section 26 and two substantially identical top support sections 28. The base support section 26 comprises a lower structural planar support section 30 defining a support surface having a shape substantially identical to the base section 16 of the air conditioning unit 10. The base support 26 further includes four upwardly extending side walls 32. The side walls are integrally formed with the base 30 and with one another and cooperate with one another to define a peripherally extending substantially rectangular upwardly facing surface 34. As seen in FIG. 3, the upwardly facing surface 34 has at each of the four corners 36 thereof a slightly recessed region 38. The base and the interior of the side walls 32 cooperate to define four corners 39 in the base support section 26.

Each of the top support members 28 includes a horizontally extending top wall 40, a vertically extending front wall 42, which includes a horizontal section 44 and a pair of vertical wall sections 46 at opposite ends thereof. The top support further includes two vertically extending end walls 48. The top wall 40, the vertical section 46 of the front wall 42 and the end walls 48 cooperate to define two interior corners 50. As illustrated in FIG. 2, the two top supports 28 are positioned with their interior corners 50 receiving the top corners 22 of the air conditioner housing 12 and with downwardly facing surfaces 45 defined by the lower ends of the vertical sections 46 and the end walls 48 in confronting relation with the recessed regions 38 in the upwardly facing surface 34 of the base support 26.

The length of the vertical sections 46 and the end walls 48 are such that with the air conditioning unit 10 positioned in the base support 26 and the top supports in place, the top supports are in load bearing contact with the recessed region 38 of the upwardly facing surface. As a result, when the air conditioning unit with the protector assembly 24 installed therearound is enclosed in an outer shipping container 47, any weight imparted to the top of the shipping container will be passed through the top support members 28 through the vertical sections 46 and 48 to the base support 26, not through the air conditioner.

Figure 4:
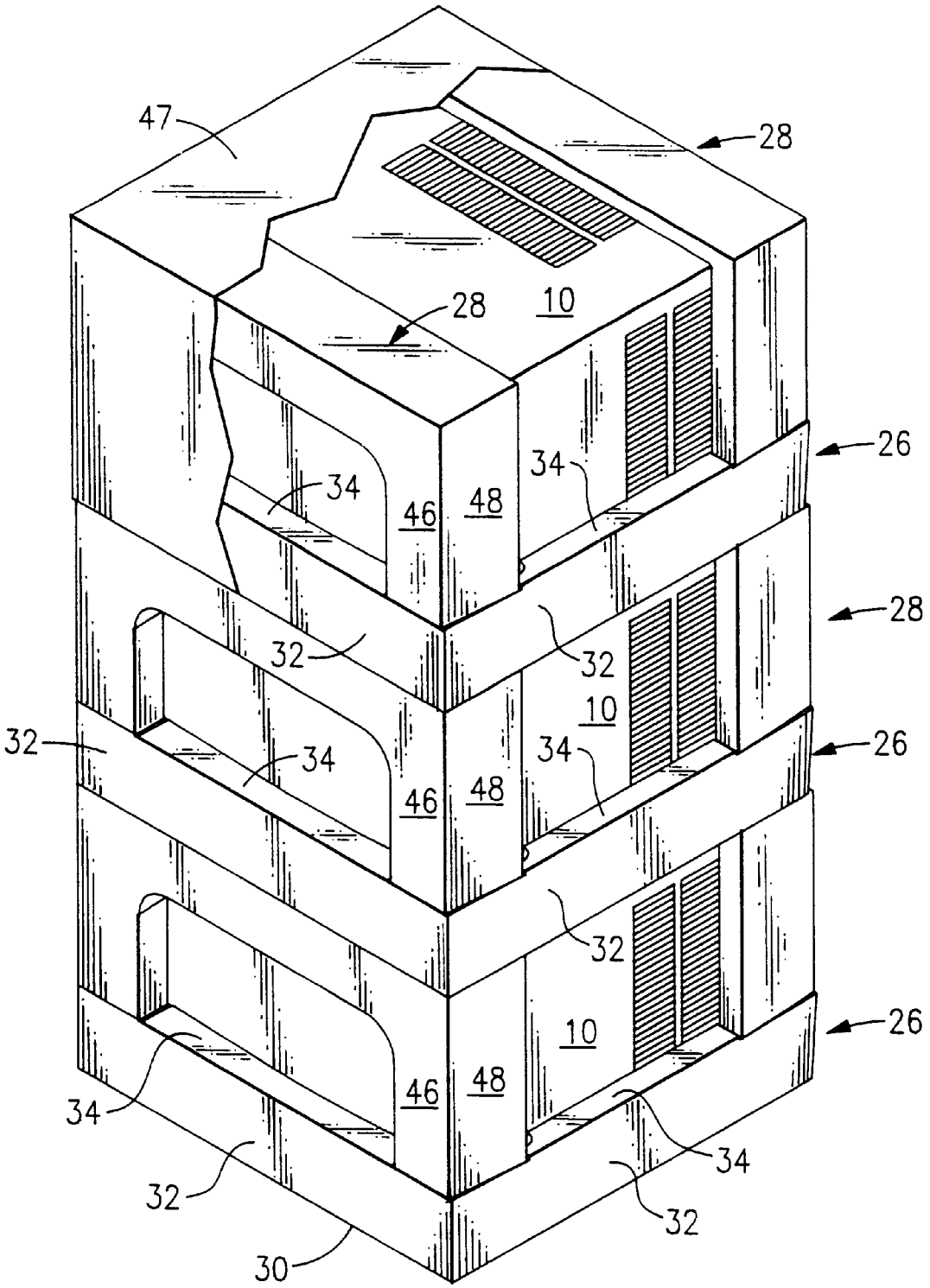
FIG. 4 illustrates three air conditioner and shipping protector combinations, as illustrated in FIG. 2, stacked one upon another.

FIG. 4 illustrates a plurality of air conditioning units 10 packaged as described above with most of the outer container 47 removed therefrom to illustrate clearly the load path through the protector assemblies 24, effectively bypassing the housing 16 of the air conditioning unit and, thus, protecting the unit from distortion and damage as a result of vertical loads imparted thereto during shipping and storage.

Further, because the base 30 of the base support 26 fully supports the base 16 of the air conditioning unit, no distortion to the basepan will occur during shipping due to warping of the basepan or the like, which may occur during rough treatment which may cause the internal components of the air conditioner, specifically the compressor, to impart potentially damaging loads on the basepan were it not fully supported.

What is claimed is:

1. The combination of an article and a shipping protector configured to be disposed between said article and a container for the article said article comprising:

a substantially rectangular solid having a base having four base corners and a top having four top corners, each of said top corners lying in substantially vertically spaced relationship with one of said base corners, said shipping protector comprising:

a base support configured to engage said base and each of said base corners, said base support having a thickness sufficient to define an upwardly facing surface adjacent each of said base corners;

a first top support configured to engage two of said top corners and having a downwardly extending structural section adjacent each of said corners, each of said downwardly extending structures having a lower end and a length sufficient to allow said lower ends thereof to engage said upwardly facing surfaces associated with one of said base corners;

a second top support configured to engage the other two of said top corners and having a downwardly extending structural section adjacent each of said corners, each of said downwardly extending structures having a lower end and a length sufficient to allow said lower end thereof to engage said upwardly facing surfaces associated with one of said base corners;

whereby vertical forces applied to said top supports will be transferred through said downwardly extending structural sections of said first and second top supports to said base support.

2. The apparatus of claim 1 wherein said base of said article defines a substantially planar bottom, and said base support includes a substantially planar, horizontally extending, bottom support configured to underlie and substantially and completely contact said bottom.

3. The apparatus of claim 2 wherein said planar bottom support is substantially rectangular and said base support further includes four vertical wall sections integrally formed with said bottom support, one of said wall sections extending vertically upwardly from each side of said rectangular bottom support, said vertical walls cooperating to define said upwardly facing surfaces.

4. The apparatus of claim 3 wherein each of said first and second top supports comprises a top wall section configured to overlie two adjacent corners of said top of said article, and wherein each of said downwardly extending structural sections is integrally formed with an end of one of said top wall sections.

5. The apparatus of claim 4 wherein each of said top walls has a perpendicularly, downwardly extending side wall integrally formed therewith, the upper of each of said downwardly extending structural sections being integrally formed with one of said top walls and its associated side wall.

* * * * *